US010376043B1

(12) United States Patent
Chu et al.

(10) Patent No.: US 10,376,043 B1
(45) Date of Patent: Aug. 13, 2019

(54) BEDSIDE DINING TABLE WITH ANGULAR POSITION ADJUSTING STRUCTURE

(71) Applicants: Zooey Chia-Tien Chu, Byron Center, MI (US); Douglas Pan, Tainan (TW)

(72) Inventors: Zooey Chia-Tien Chu, Byron Center, MI (US); Douglas Pan, Tainan (TW)

( * ) Notice: Subject to any disclaimer, the term of this patent is extended or adjusted under 35 U.S.C. 154(b) by 0 days.

(21) Appl. No.: 15/953,587

(22) Filed: Apr. 16, 2018

(51) Int. Cl.
*A47B 23/00* (2006.01)
*A47B 23/04* (2006.01)
*A47B 13/02* (2006.01)

(52) U.S. Cl.
CPC ..... *A47B 23/046* (2013.01); *A47B 13/023* (2013.01); *A47B 2013/024* (2013.01); *A47B 2023/047* (2013.01)

(58) Field of Classification Search
CPC . A47B 23/046; A47B 13/02; A47B 2013/024; A47B 2023/047; A47B 3/00; A47B 7/00; A47B 7/02; A47B 27/18; A47B 2003/00; A47B 2009/003; A47B 2200/0036; A47B 2200/0035; A47B 2200/004; A47B 41/02; A47B 3/083; A47B 2200/0043
USPC ..... 248/188.6, 425, 166, 439; 312/233, 231; 108/6–8, 91, 115
See application file for complete search history.

(56) References Cited

U.S. PATENT DOCUMENTS

| | | | | | |
|---|---|---|---|---|---|
| 1,512,291 | A * | 10/1924 | McGuire | A47B 23/046 | 108/8 |
| 1,916,537 | A * | 7/1933 | Smith | A47B 23/046 | 108/8 |
| 3,435,783 | A * | 4/1969 | Kollenborn | A47B 23/046 | 108/141 |
| 3,640,228 | A * | 2/1972 | Busse | A47B 9/20 | 108/10 |
| 8,272,336 | B2 * | 9/2012 | Rutz | A47B 3/08 | 108/115 |
| 2007/0209559 | A1 * | 9/2007 | Mockel | A47B 3/0803 | 108/115 |

(Continued)

FOREIGN PATENT DOCUMENTS

| | | |
|---|---|---|
| DE | 1917825 | * 10/1970 |
| DE | 19960199 | * 6/2001 |

(Continued)

*Primary Examiner* — Janet M Wilkens
(74) *Attorney, Agent, or Firm* — Alan D. Kamrath; Mayer & Williams PC

(57) ABSTRACT

A bedside dining table includes a supporting beam mounted on top of a vertical leg. A table is mounted on a top of the supporting beam. First and second axle seats are coupled to the supporting beam. The first axle seat includes a plurality of angularly spaced positioning holes. First and second pivotal seats are coupled to the table. Two axles respectively extend through axle holes of the first and second pivotal seats and the first and second pivotal seats to permit pivotal movement therebetween. Each of the first and second pivotal seats includes an arcuate abutment face abutting an arcuate abutment face of one of the first and second axle seats. A positioning seat is mounted to the first pivotal seat. A positioning rod extends through the positioning seat and is biased by an elastic element into one of the plurality of positioning holes of the first axle seat.

5 Claims, 6 Drawing Sheets

(56) References Cited

U.S. PATENT DOCUMENTS

| | | | | |
|---|---|---|---|---|
| 2007/0261609 | A1* | 11/2007 | Kumazawa | A47B 3/0815 108/6 |
| 2008/0295742 | A1* | 12/2008 | Henriott | A47B 21/00 108/6 |
| 2009/0283020 | A1* | 11/2009 | Hsu | A47B 3/0815 108/115 |
| 2010/0071600 | A1* | 3/2010 | Lin | A47B 3/08 108/115 |
| 2010/0258042 | A1* | 10/2010 | Rutz | A47B 3/0818 108/115 |
| 2011/0017107 | A1* | 1/2011 | Ko | A47B 3/0818 108/64 |
| 2011/0139042 | A1* | 6/2011 | Korb | A47B 3/00 108/115 |
| 2014/0182488 | A1* | 7/2014 | Lu | A47B 27/16 108/6 |
| 2015/0118010 | A1* | 4/2015 | Krusin | A47B 7/02 414/801 |
| 2015/0223600 | A1* | 8/2015 | Pan | A47B 41/02 108/91 |

FOREIGN PATENT DOCUMENTS

| | | | |
|---|---|---|---|
| FR | 2063591 | * | 7/1971 |
| FR | 2704283 | * | 10/1994 |
| FR | 2918859 | * | 1/2009 |
| GB | 410953 | * | 5/1934 |
| TW | 447272 U | | 7/2001 |

* cited by examiner

A - A

B – B

BEDSIDE DINING TABLE WITH ANGULAR POSITION ADJUSTING STRUCTURE

BACKGROUND OF THE INVENTION

The present invention relates to a bedside dining table with an angular position adjusting structure and, more particularly, to a bedside dining table permitting easy adjustment of an angular position of a table while providing a better positioning effect and supporting stability.

A conventional bedside dining table generally includes a movable leg unit and a table mounted on top of the leg unit. The table is located above a bed to permit a patient or a disabled person to dine in bed.

However, the table in a horizontal position is not suitable for the person in bed for reading purposes. In an approach disclosed in Taiwan Patent No. 447272, a bedside dining table includes a leg unit having a telescopic tube. The telescopic tube includes an upper end having a plurality of positioning holes. A supporting rod is mounted below a table and includes an end having a U-shaped bracket pivotably connected to the upper end of the telescopic tube. A positioning pin is mounted to the bracket and is selectively engaged with one of the plurality of positioning holes. Thus, the table is pivotable relative to the telescopic tube through provision of the bracket. After the angular adjustment, the positioning pin is selectively engaged with one of the plurality of positioning holes.

However, the supporting stability is not good, because the table has only one pivotable connection with the telescopic tube by the bracket. Furthermore, the plurality of positioning holes is exposed and, thus, fails to provide an integrity appearance.

BRIEF SUMMARY OF THE INVENTION

An objective of the present invention is to provide a bedside dining table permitting easy adjustment of an angular position of a table while providing a better positioning effect and supporting stability as well as integrity.

A bedside dining table according to the present invention includes a leg unit, a table, first and second axle seats, first and second pivotal seats, and a positioning device. The leg unit includes a vertical leg and a supporting beam mounted on a top end of the vertical leg and extending in a longitudinal direction. The supporting beam includes an upper side having a first coupling portion and a second coupling portion spaced from the first coupling portion in the longitudinal direction. The table is mounted on a top of the supporting beam. The table includes a bottom side having a third coupling portion and a fourth coupling portion spaced from the third coupling portion. The first and second axle seats are respectively coupled to the first coupling portion and the second coupling portion of the supporting beam. Each of the first and second axle seats includes a central portion having an axle hole extending in the longitudinal direction of the supporting beam. Each of the first and second axle seats includes a top end having an arcuate abutment face. The first axle seat includes a plurality of positioning holes spaced from each other in an angular direction. The first and second pivotal seats are respectively coupled to the third coupling portion and the fourth coupling portion of the table. Each of the first and second pivotal seats includes a central portion having an engaging groove for receiving the top end of one of the first and second axle seats. The engaging groove of each of the first and second pivotal seats includes two sidewalls. Each of the two sidewalls has an axle hole. Two axles respectively extend through the axle holes of the first and second pivotal seats and the axle holes of the first and second axle seats, such that the first and second pivotal seats are respectively pivotable relative to the first and second axle seats. Each of the first and second pivotal seats includes an arcuate abutment face abutting with the arcuate abutment face of one of the first and second axle seats. One of the two sidewalls of the first pivotal seat 4 includes an insertion hole selectively aligned with one of the plurality of positioning holes of the first axle seat. The positioning device includes a positioning seat, a positioning rod, and an elastic element. The positioning seat is mounted to the one of the two sidewalls of the first pivotal seat. The positioning seat includes a receiving groove aligned with the insertion hole of the first pivotal seat. The receiving groove includes two ends respectively having a first through-hole and a second through-hole. The positioning rod extends through the receiving groove of the positioning seat, the insertion hole of the first pivotal seat, and one of the plurality of positioning holes of the first axle seat. The positioning rod includes a positioning end and a gripping end located outside of the receiving groove. The elastic element biases the positioning end of the positioning rod into one of the plurality of positioning holes of the first axle seat. The gripping end is adapted to be pulled to disengage the positioning end of the positioning rod from the one of the plurality of positioning holes of the first axle seat.

In an example, the second through-hole of the receiving groove of the positioning seat includes an inner periphery having a stop edge located corresponding to the receiving groove. The positioning rod includes a stop. The elastic element is a spring mounted in the receiving groove of the positioning seat and includes a coil portion mounted around the positioning rod. The spring includes a first tang abutting against the stop edge of the positioning seat and a second tang abutting against the stop of the positioning rod.

In an example, the one of the two sidewalls of the first pivotal seat includes a plurality of pegs. Each of the plurality of pegs has a coupling hole. The positioning seat includes a plurality of grooves aligned with the plurality of pegs. Each of the plurality of grooves has a coupling hole. The positioning seat is mounted to the one of the two sidewalls of the first pivotal seat. The plurality of grooves is respectively engaged with the plurality of pegs. A plurality of fasteners respectively extends through the coupling holes of the plurality of grooves and the coupling holes of the plurality of pegs.

In an example, each of the plurality of positioning holes of the first axle seat includes a front end with an opening. Each opening includes a diameter larger than a diameter of a rear end of a respective one of the plurality of positioning holes. The positioning end of the positioning rod has a front section and a rear section. The front section of the positioning end has a diameter smaller than a diameter of the rear section of the positioning end.

In an example, the bedside dining table further includes a cover having an annular wall. The cover includes a lower side having an opening located corresponding to the supporting beam. The cover further includes an upper side coupled with outer sides of the third coupling portion and the fourth coupling portion. The annular wall includes a slot through which the positioning rod extends.

The present invention will become clearer in light of the following detailed description of illustrative embodiments of this invention described in connection with the drawings.

DETAILED DESCRIPTION OF THE INVENTION

Figure 1:
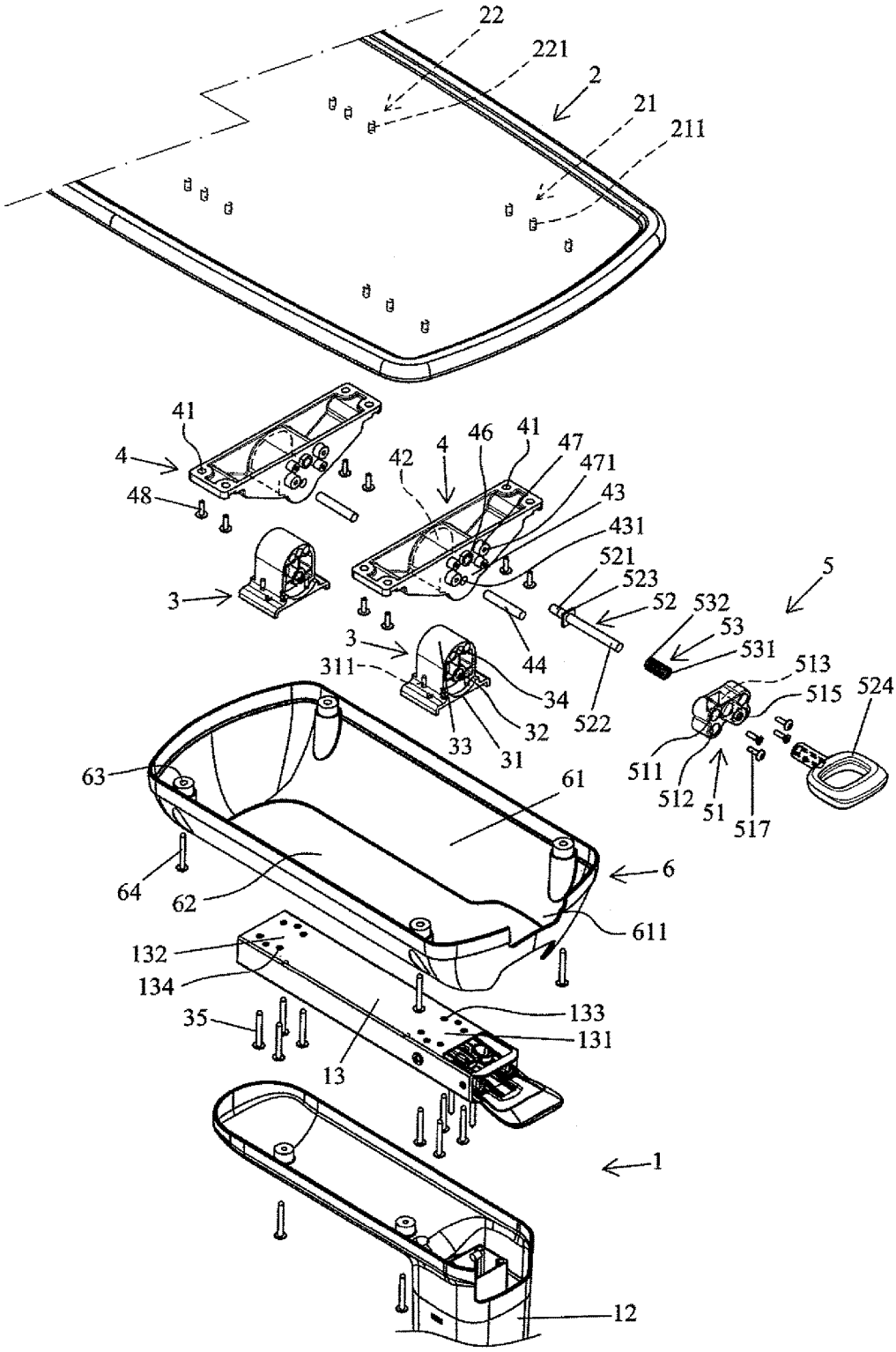
FIG. 1 is an exploded, perspective view of a bedside dining table of an embodiment according to the present invention.
Figure 2:
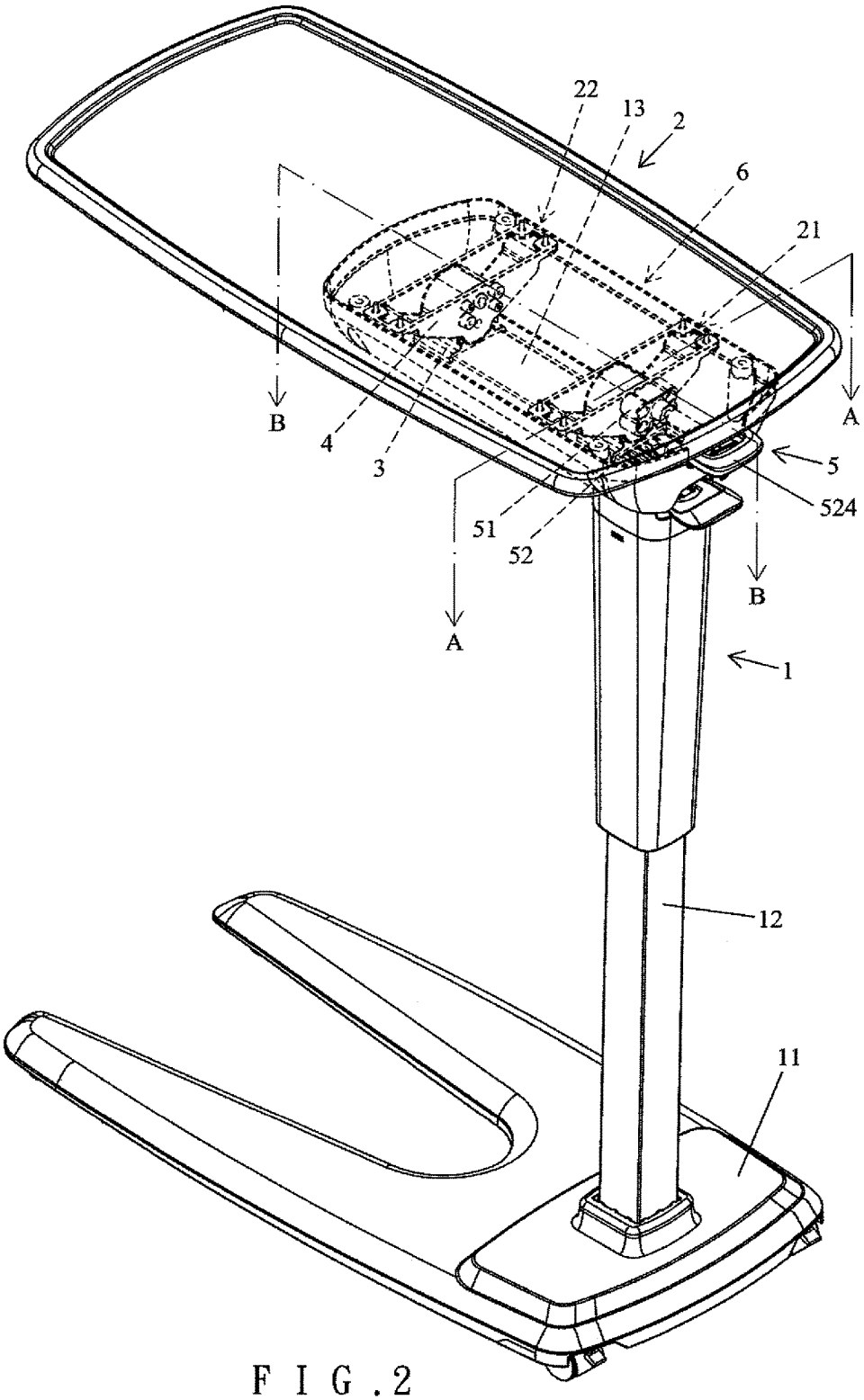
FIG. 2 is a perspective view of the bedside dining table of FIG. 1.
Figure 3:
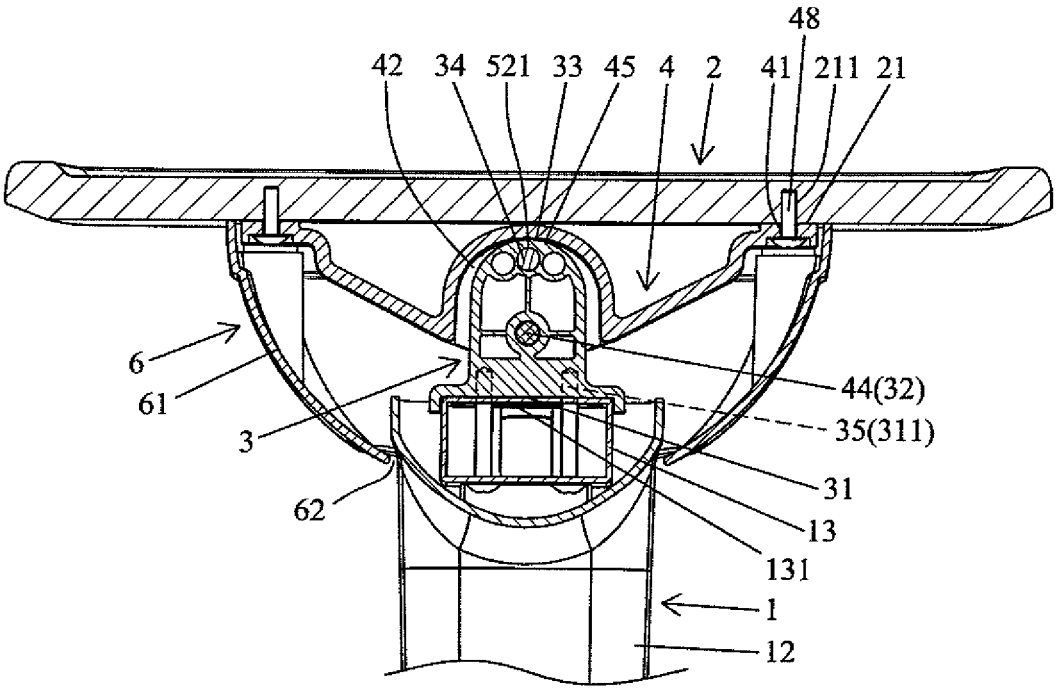
FIG. 3 is a cross sectional view taken along section line A-A of FIG. 2.
Figure 4:
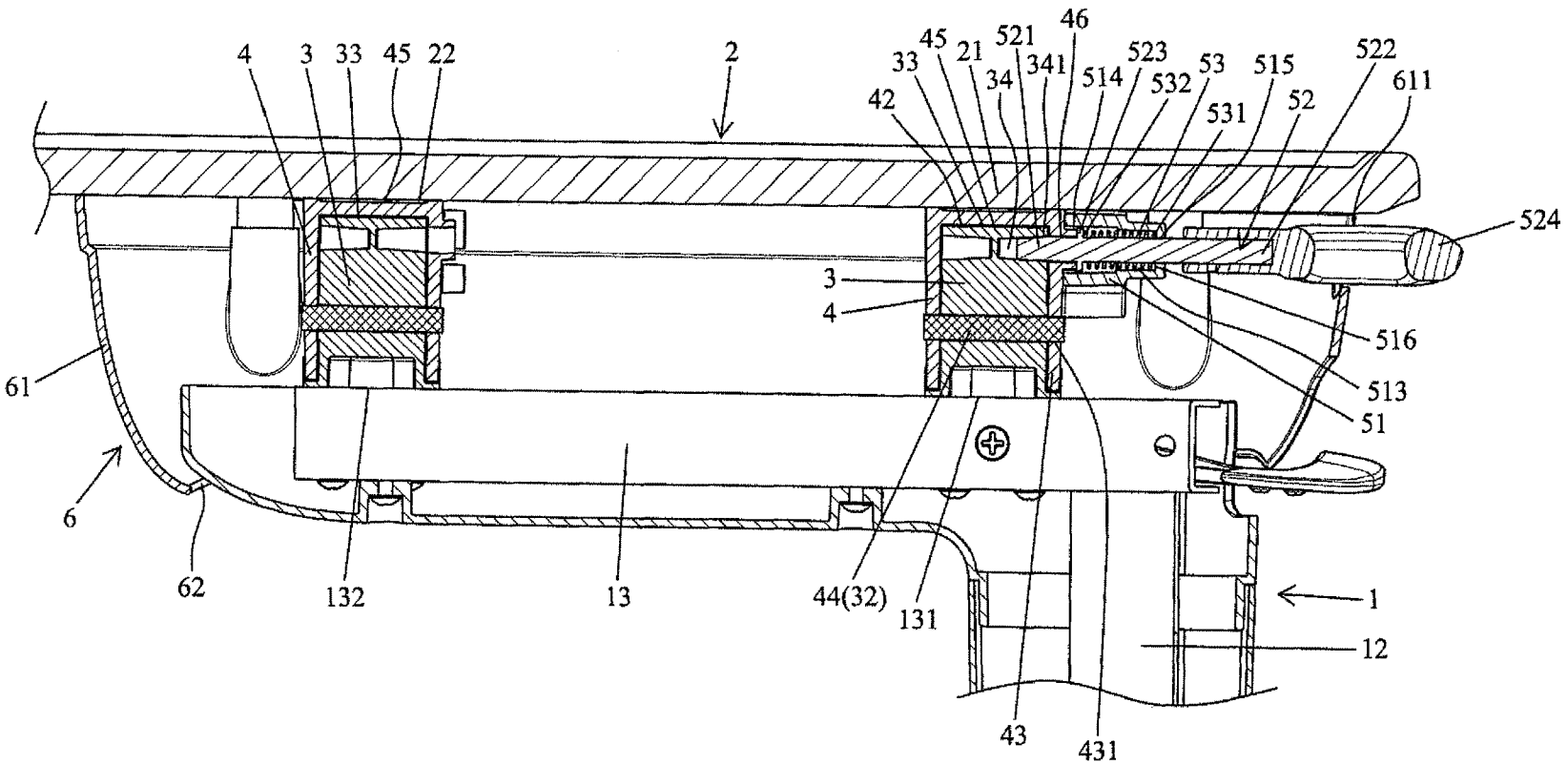
FIG. 4 is a cross sectional view taken along section line B-B of FIG. 2.

With reference to FIGS. 1-4, a bedside dining table of an embodiment according to the present invention includes a leg unit 1, a table 2, first and second axle seats 3, first and second pivotal seats 4, a positioning device 5, and a cover 6. The leg unit 1 includes a base 11 adapted to be placed on the ground. A vertical leg 12 extends upright from the base 11. A supporting beam 13 is mounted on a top end of the vertical leg 12 and extending in a longitudinal direction. The supporting beam 13 includes an upper side having a first coupling portion 131 and a second coupling portion 132 spaced from the first coupling portion 131 in the longitudinal direction. Each of the first and second coupling portions 131 and 132 has at least one coupling hole 133, 134.

The table 2 is mounted on a top of the supporting beam 13. The table 2 includes a bottom side having a third coupling portion 21 and a fourth coupling portion 22 spaced from the third coupling portion 22. Each of the third and fourth coupling portions 21 and 22 has at least one coupling hole 211, 221.

The first and second axle seats 3 are respectively coupled to the first coupling portion 131 and the second coupling portion 132 of the supporting beam 13. Each of the first and second axle seats 3 includes a lower side having an engaging groove 31 for coupling with the top side of the supporting beam 13. Fasteners 35 extend through coupling holes 311 of each of the first and second axle seats 3 to couple with the supporting beam 13. Each of the first and second axle seats 3 further includes a central portion having an axle hole 32 extending in the longitudinal direction of the supporting beam 13. Each of the first and second axle seats 3 includes a top end having an arcuate abutment face 33. Each of the first and second axle seats 3 includes a plurality of positioning holes 34 (three positioning holes 34 in this embodiment) spaced from each other in an angular direction. Each of the plurality of positioning holes 34 of the first axle seat 3 includes a front end having an opening 341 with a diameter larger than a diameter of a rear end of the positioning hole 34. It can be appreciated that the second axle seat 3 does not have to include the positioning holes 34.

The first and second pivotal seats 4 include coupling holes 41 and are respectively coupled with the coupling holes 211 and 221 of the third coupling portion. 21 and the fourth coupling portion 22 of the table 2 by fasteners 48. Each of the first and second pivotal seats 4 includes a central portion having an engaging groove 42 for receiving the top end of one of the first and second axle seats 3. The engaging groove 42 of each of the first and second pivotal seats 4 includes two sidewalls 43. Each of the two sidewalls 43 has an axle hole 431. Two axles 44 respectively extend through the axle holes 431 of the first and second pivotal seats 4 and the axle holes 32 of the first and second axle seats 3, such that the first and second pivotal seats 4 are respectively pivotable relative to the first and second axle seats 3. Each of the first and second pivotal seats 4 includes an arcuate abutment face 45 abutting with the arcuate abutment face 32 of one of the first and second axle seats 3. One of the two sidewalls 43 of the first pivotal seat 4 includes an insertion hole 46 selectively aligned with one of the plurality of positioning holes 34 of the first axle seat 3. The one of the two sidewalls 43 of the first pivotal seat 4 includes a plurality of pegs 47. Each of the plurality of pegs 47 has a coupling hole 471.

The positioning device 5 includes a positioning seat 51, a positioning rod 52, and an elastic element 53. The positioning seat 51 includes a plurality of grooves 511 aligned with the plurality of pegs 47. Each of the plurality of grooves 511 has a coupling hole 512. The positioning seat 51 is mounted to one of the two sidewalls of the first pivotal seat 4. The plurality of grooves 511 is respectively engaged with the plurality of pegs 47. A plurality of fasteners 517 respectively extends through the coupling holes 512 of the plurality of grooves 511 and the coupling holes 471 of the plurality of pegs 47. Furthermore, the positioning seat 51 includes a receiving groove 513 aligned with the insertion hole 46 of the first pivotal seat 4. The receiving groove 513 includes two ends respectively having a first through-hole 514 and a second through-hole 515. The second through-hole 515 of the receiving groove 513 of the positioning seat 51 includes an inner periphery having a stop edge 516 located corresponding to the receiving groove 513.

The positioning rod 52 extend through the receiving groove 513 of the positioning seat 51, the insertion hole 46 of the first pivotal seat 4, and one of the plurality of positioning holes 34 of the first axle seat 3. The positioning rod 52 includes a positioning end 521 and a gripping end 522 located outside of the receiving groove 513. The positioning end 521 of the positioning rod 52 has a front section and a rear section. The front section of the positioning end 521 has a diameter smaller than a diameter of the rear section of the positioning end 521. A handle 524 is coupled to the gripping end 522. Furthermore, the positioning rod 52 includes a stop 523.

The elastic element 53 biases the positioning end 521 of the positioning rod 52 into one of the plurality of positioning holes 34 of the first axle seat 3. The handle 524 coupled to the gripping end 522 can be pulled to disengage the positioning end 521 of the positioning rod 52 from the plurality of positioning holes 34 of the first axle seat 3. In this embodiment, the elastic element 53 is a spring mounted in the receiving groove 513 of the positioning seat 51 and includes a coil portion mounted around the positioning rod 52. The spring includes a first tang 531 abutting against the stop edge 516 of the positioning seat 51 and a second tang 532 abutting against the stop 523 of the positioning rod 52.

The cover 6 includes an annular wall 61. The cover 6 includes a lower side having an opening 62 located corresponding to the supporting beam 13. The cover 6 further includes an upper side having coupling holes 63 coupled with outer sides of the third coupling portion 21 and the fourth coupling portion 22 by fasteners 64. The annular wall 61 includes a slot 611 through which the positioning rod 52 extends. The cover 6 covers the first and second axle seats 3, the first and second pivotal seats 4, and the positioning seat 51 to improve the assembly quality.

Figure 5:
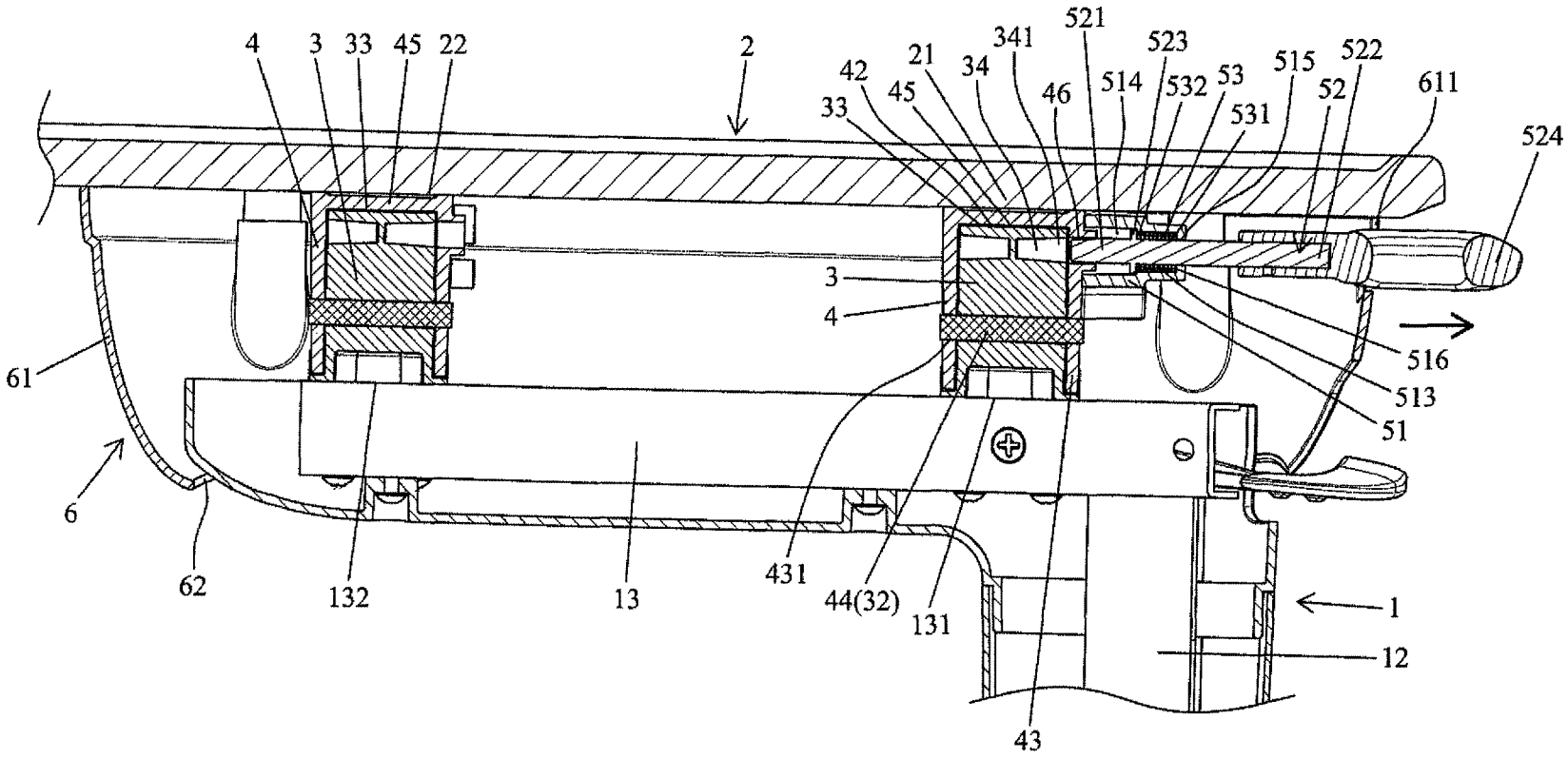
FIG. 5 is a view similar to FIG. 4, with a positioning rod disengaged from a positioning hole.
Figure 6:
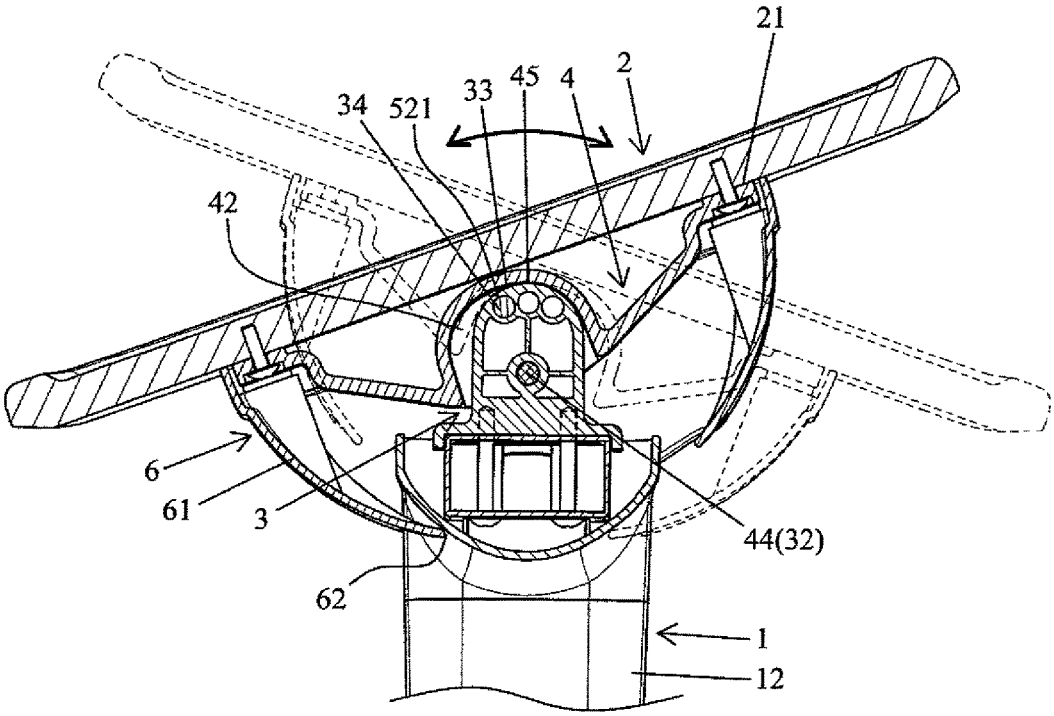
FIG. 6 is a diagrammatic view illustrating adjustment of an angular position of a table of the bedside dining table.

The positioning rod 52 is biased by the elasticity of the elastic element 53 to engage with one of the plurality of positioning holes 34 to thereby retain the angular position of the table 2. The diameter of each opening 341 is larger than the diameter of the rear end of the respective positioning hole 34. Furthermore, the diameter of the front section of the positioning rod 52 is smaller. Thus, insertion of the positioning rod 52 is easier for positioning. With reference to FIG. 5, the positioning rod 52 can be pulled to disengage from the positioning holes 34. Furthermore, the stop 523 presses against the elastic element 53. With reference to FIGS. 5 and 6, the first and second pivotal seats 4 can pivot relative to the first and second axle seats 3 through use of the axles 44. The arcuate abutment faces 45 of the first and second pivotal seats 4 abut with the arcuate abutment faces 33 of the first and second axle seats 3. A double stable supporting effect is provided. Furthermore, after adjustment, the handle 524 is released, and the positioning rod 52 is biased by the elasticity of the elastic element 53, such that the positioning end 521 is inserted into another positioning hole 34, providing easy adjustment.

In view of the foregoing, the angular adjustment of the bedside dining table according to the present invention is easy while providing a stable supporting effect than conventional tables, increasing use safety and supporting stability for persons in bed.

Although specific embodiments have been illustrated and described, numerous modifications and variations are still possible without departing from the scope of the invention. The scope of the invention is limited by the accompanying claims.

The invention claimed is:

1. A bedside dining table comprising:

a leg unit including a vertical leg and a supporting beam mounted on a top end of the vertical leg and extending in a longitudinal direction, wherein the supporting beam includes an upper side having a first coupling portion and a second coupling portion spaced from the first coupling portion in the longitudinal direction;

a table mounted on a top of the supporting beam, wherein the table includes a bottom side having a third coupling portion and a fourth coupling portion spaced from the third coupling portion;

first and second axle seats respectively coupled to the first coupling portion and the second coupling portion of the supporting beam, wherein each of the first and second axle seats includes a central portion having an axle hole extending in the longitudinal direction of the supporting beam, wherein each of the first and second axle seats includes a top end having an arcuate abutment face, and wherein the first axle seat includes a plurality of positioning holes spaced from each other in an angular direction;

first and second pivotal seats respectively coupled to the third coupling portion and the fourth coupling portion of the table, wherein each of the first and second pivotal seats includes a central portion having an engaging groove for receiving the top end of one of the first and second axle seats, wherein the engaging groove of each of the first and second pivotal seats includes two sidewalls, wherein each of the two sidewalls has an axle hole, wherein two axles respectively extend through the axle holes of the first and second pivotal seats and the axle holes of the first and second axle seats, such that the first and second pivotal seats are respectively pivotable relative to the first and second axle seats, wherein each of the first and second pivotal seats includes an arcuate abutment face abutting with the arcuate abutment face of one of the first and second axle seats, and wherein one of the two sidewalls of the first pivotal seat includes an insertion hole selectively aligned with one of the plurality of positioning holes of the first axle seat; and a positioning device including a positioning seat, a positioning rod, and an elastic element, wherein the positioning seat is mounted to the one of the two sidewalls of the first pivotal seat, wherein the positioning seat includes a receiving groove aligned with the insertion hole of the first pivotal seat, wherein the receiving groove includes two ends respectively having a first through-hole and a second through-hole, wherein the positioning rod extends through the receiving groove of the positioning seat, the insertion hole of the first pivotal seat, and one of the plurality of positioning holes of the first axle seat, and wherein the positioning rod includes a positioning end and a gripping end located outside of the receiving groove, wherein the elastic element biases the positioning end of the positioning rod into one of the plurality of positioning holes of the first axle seat, and wherein the gripping end is adapted to be pulled to disengage the positioning end of the positioning rod from the one of the plurality of positioning holes of the first axle seat.

2. The bedside dining table as claimed in claim 1, wherein the second through-hole of the receiving groove of the positioning seat includes an inner periphery having a stop edge located corresponding to the receiving groove, wherein the positioning rod includes a stop, wherein the elastic element is a spring mounted in the receiving groove of the positioning seat and includes a coil portion mounted around the positioning rod, and wherein the spring includes a first tang abutting against the stop edge of the positioning seat and a second tang abutting against the stop of the positioning rod.

3. The bedside dining table as claimed in claim 1, wherein the one of the two sidewalls of the first pivotal seat includes a plurality of pegs, wherein each of the plurality of pegs has a coupling hole, wherein the positioning seat includes a plurality of grooves aligned with the plurality of pegs, wherein each of the plurality of grooves has a coupling hole, wherein the positioning seat is mounted to the one of the two sidewalls of the first pivotal seat, wherein the plurality of grooves is respectively engaged with the plurality of pegs, and wherein a plurality of fasteners respectively extends through the coupling holes of the plurality of grooves and the coupling holes of the plurality of pegs.

4. The bedside dining table as claimed in claim 1, wherein each of the plurality of positioning holes of the first axle seat includes a front end with an opening, wherein each opening includes a diameter larger than a diameter of a rear end of a respective one of the plurality of positioning holes, wherein the positioning end of the positioning rod has a front section and a rear section, and wherein the front section of the positioning end has a diameter smaller than a diameter of the rear section of the positioning end.

5. The bedside dining table as claimed in claim 1, further comprising a cover having an annular wall, wherein the cover includes a lower side having an opening located corresponding to the supporting beam, wherein the cover further includes an upper side coupled with outer sides of the third coupling portion and the fourth coupling portion, and wherein the annular wall includes a slot through which the positioning rod extends.

* * * * *